US007525447B2

(12) United States Patent
Galindo

(10) Patent No.: US 7,525,447 B2
(45) Date of Patent: Apr. 28, 2009

(54) EMERGENCY VEHICLE ALERT SYSTEM

(76) Inventor: Rex K. Galindo, 431 NW. 188th Ter., Pembroke Pines, FL (US) 33029

( * ) Notice: Subject to any disclaimer, the term of this patent is extended or adjusted under 35 U.S.C. 154(b) by 16 days.

(21) Appl. No.: 11/339,236

(22) Filed: Jan. 24, 2006

(65) Prior Publication Data

US 2006/0176191 A1 Aug. 10, 2006

Related U.S. Application Data

(60) Provisional application No. 60/646,400, filed on Jan. 24, 2005.

(51) Int. Cl.
*G08G 1/01* (2006.01)

(52) U.S. Cl. ..... 340/933; 340/901; 340/902; 340/932; 340/691.3; 340/870.28; 701/300; 701/301

(58) Field of Classification Search ..... 340/933, 340/901, 436, 500, 570.1, 988, 572.1, 870.28, 340/932, 691.3, 686.6; 701/301, 300, 302; 705/13; 246/122

See application file for complete search history.

(56) References Cited

U.S. PATENT DOCUMENTS

| | | | | |
|---|---|---|---|---|
| 3,949,300 | A | 4/1976 | Sadler | |
| 3,997,868 | A | 12/1976 | Ribnick et al. | |
| 4,238,778 | A | 12/1980 | Ohsumi | |
| 4,573,049 | A | 2/1986 | Obeck | |
| 4,764,978 | A | 8/1988 | Argo et al. | |
| 5,497,148 | A * | 3/1996 | Oliva | 340/905 |
| 5,572,201 | A | 11/1996 | Graham et al. | |
| 5,680,119 | A * | 10/1997 | Magliari et al. | 340/904 |
| 5,926,112 | A * | 7/1999 | Hartzell | 340/902 |
| 6,025,789 | A | 2/2000 | Lane et al. | |
| 6,326,903 | B1 | 12/2001 | Gross et al. | |
| 6,614,362 | B2 | 9/2003 | Siegel | |
| 6,686,849 | B1 * | 2/2004 | Cullett | 340/902 |
| 2002/0008635 | A1 * | 1/2002 | Ewing et al. | 340/902 |
| 2003/0201906 | A1 * | 10/2003 | Buscemi | 340/902 |
| 2005/0278078 | A1 * | 12/2005 | Sterling | 701/1 |

* cited by examiner

*Primary Examiner*—Benjamin C Lee
*Assistant Examiner*—Sisay Yacob
(74) *Attorney, Agent, or Firm*—Laurence A. Greenberg; Werner H. Stemer; Ralph E. Locher

(57) ABSTRACT

A traffic entity, such as a passenger car, is warned that a situation requiring the change of driving mode will be required. The traffic entity is alerted to the presence of a second traffic entity, such as an emergency vehicle which requires the moving traffic entity to change its movement when it is proximate to the second traffic entity. The alert is changed, such as by increasing the intensity of visible signals, as the distance between the moving traffic entity and the second traffic entity decreases or the closing speed between the two entities increases, and the mode of the alert is changed, such as from visible to audible, as the distance between the entities further decreases or the closing speed further increases. A variety of traffic entities are accommodated by the system.

13 Claims, 1 Drawing Sheet

EMERGENCY VEHICLE ALERT SYSTEM

RELATED APPLICATION

This application claims priority to a provisional application No. 60/646,400 filed Jan. 24, 2005, which is hereby incorporated by reference.

TECHNICAL FIELD OF THE INVENTION

The present invention relates to the general art of systems for alerting a driver of the proximity of another vehicle that requires the right of way, and to the particular field of improving such systems.

BACKGROUND OF THE INVENTION

Since the earliest times, emergency vehicles have depended upon sirens, horns, bells or other types of audible and/or visible warning devices to alert other people in the path of the vehicle. Trains and school buses, also, have depended on such alarms that are generated on or by the vehicle itself. It is here noted that for the purposes of this disclosure, such emergency vehicles, buses, police vehicles, school buses and the like will be referred to as either "warning vehicles" or as "vehicles requiring a right of way," or, more broadly, as a "warning entity" to encompass not only vehicles, but zones, such as school zones, hospital zones, zones near special needs individuals, and the like, as well, while the vehicle being warned will often be referred to as the "warned vehicle," or as a "warned entity." However, the passenger compartments of automobile vehicles have become increasingly insulated from outside noise. Thus, driver and occupants of warned vehicles have become relatively isolated from normally audible danger signals such as sirens, whistles and horns which generate sound waves which are to a large extent attenuated before reaching the driver's ears. This trend towards an increased isolation of the occupants, and especially the driver, has been enhanced because of the use of air conditioning which encourages the driver and passengers to keep the windows of the vehicle closed. When, for example, the windows of a vehicle are closed and the radio is playing, the aforementioned warning signals are often not heard, thereby placing the driver and the passengers in the vehicle in a potentially dangerous circumstance and increasing the probability that a clear right of way may be delayed for the emergency vehicle. Further, a dangerous traffic condition can arise where an unwarned driver obstructs an emergency vehicle which is often traveling at high speed.

Furthermore, whenever an emergency vehicle is traveling under conditions of urgency, the problem of passing through busy street intersections represents a dangerous problem to both the emergency vehicle and to the general traffic at or in the vicinity of the intersection. As discussed above, the problem has become especially severe in recent years when many drivers travel in air conditioned cars with their windows rolled up and often with the radio turned on so that they may be unable to hear the siren of an approaching emergency vehicle. Many serious accidents happen each year as a result of collisions between emergency vehicles and other traffic. In heavy city traffic there is still another problem in relation to the travel of emergency vehicles. As an emergency vehicle approaches a busy intersection and some of the drivers respond to the siren and pull to the curb and halt, as required, busy intersections become filled with vehicles standing still and often completely block the progress of the emergency vehicle.

Accordingly, there is a need for a system that will efficiently warn an occupant of a motor vehicle of not only the approach of another vehicle that should be given the right of way, such as an ambulance, a school bus, or a police vehicle, but will also alert the occupant of the motor vehicle that the motor vehicle is approaching a vehicle that should be given the right of way, such as a school bus that is loading or unloading passengers.

Still further, a constant concern exists as to the safety of vehicles where highways, streets and the like, intersect with railroad crossings. Despite the significant advances in technology utilized in both highway vehicles and trains, accidents involving collisions between trains and highway vehicles continue to occur, which accidents are generally catastrophic in nature. Accordingly, there is a need for a system that will warn an occupant of a motor vehicle of the approach of a train.

The inventor is aware of several attempts to satisfy the just-stated needs. However, these attempts have various shortcomings that inhibit their acceptance. Primary among these shortcomings is the fact that all of the systems of which the inventor is aware, do not make the occupant aware of how close the other vehicle is to his vehicle. Thus, due to this shortcoming, an occupant in a motor vehicle is warned of the proximity of a vehicle requiring a right of way in the same manner whether the other vehicle is very close to the warned vehicle or quite far away. This tends to cause people to ignore a warning because they feel that they are far enough away from the other vehicle to "beat" that warning vehicle and get out of the way in time. This may work in some cases, but if the warning vehicle is quite near, disastrous consequences can result.

Accordingly, there is a need for a system that will warn the occupant of a motor vehicle of the proximity of another vehicle that requires the right of way, and alerts that occupant in a manner that allows him to determine how proximate the warning vehicle is to his own vehicle. Still further, there is a need for such a system that will alert the occupant in a manner that he is not likely to ignore.

SUMMARY OF THE INVENTION

The above-discussed disadvantages of the prior art are overcome by a system that includes a transmitter in the vehicle or entity requiring the right of way, or in a zone which requires a driver or operator of a second entity to change speed and/or direction, and a receiver in the vehicle or second entity which must alter the speed and/or direction and circuitry in the receiver that will alert the occupants of the yielding vehicle, or entity, especially the operator, of the proximity of the vehicle or zone requiring a change of driving speed and/or direction. The receiver generates a signal that is dependent on the distance between the two entities and the generated signal becomes more urgent the closer the warning entity is to the warned entity. The receiver further includes circuitry that changes the type of warning signal as the two entities move closer together whereby the occupants of the warned entity are likely to notice the warning. For example, an increasingly loud audible signal is added to an increasingly brightening visual signal when the two entities are within a prescribed range and are approaching each other or are increasing the speed of their approach.

The warning vehicle, or entity, can be a school bus, a train, a fire truck, an ambulance, or police vehicles. In fact, the system of the present invention can be used to alert a driver or an occupant of a warned vehicle that the warned vehicle is approaching a school zone, and the system will alert the occupants in a manner that increases urgency as the vehicle gets closer to the school zone. Since stationary areas, such as school zones are included in the scope of the present disclosure, the term "entity" is used to denote this portion of the system.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
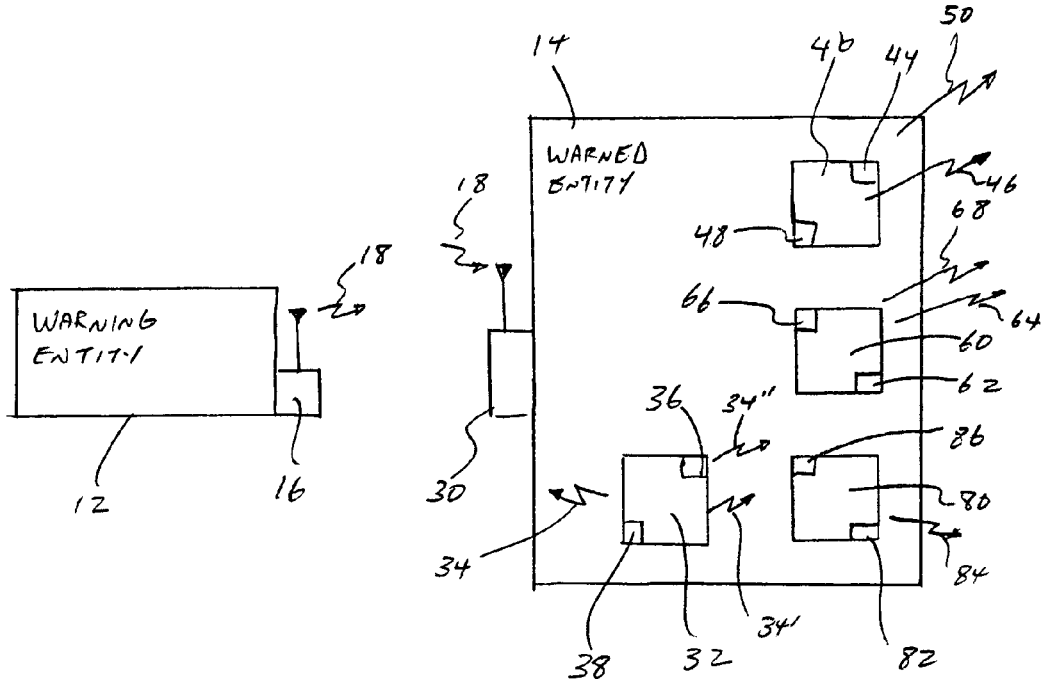
FIG. 1 is a schematic showing the overall system embodying the present invention.

Referring to the figures, it can be understood that the present invention is embodied in a system 10 for warning a traffic entity that a situation requiring the change of driving mode will be required.

System 10 comprises a first traffic entity 12, such as a school zone, a school bus, a train, a fire truck, an ambulance, a police vehicle, or the like which will affect the movement of another traffic entity 14, such as a motor vehicle, or the like. The first entity has a transmitter 16 therein which transmits a warning signal 18 over the air. The first traffic entity can also be an accident zone, a work area, a detour, or the like.

The warning signal is associated with the first entity and is unique thereto. Thus, for example, a school zone will have a warning signal associated therewith which is unique thereto, while a school bus will have another unique warning signal associated therewith, and so forth. The purpose of different and unique warning signals will be understood from the teaching of this disclosure.

Second traffic entity 14 can be a car, a motorcycle, a bus or the like, and will have its traffic movement affected by the presence of the first entity. The second traffic entity includes a receiver 30 which will receive a warning signal 18 from the transmitter in the first entity when the first and second entities are proximate to each other. The definition of "proximate" will be understood by those skilled in the art based on the teaching of the present disclosure. The distance at which the two entities are "proximate" will be a function of the type and relative speed of the two entities and the safety factors associated with these entity types and relative speeds. Thus, for example, a vehicle approaching a school zone will be considered "proximate" at one distance; whereas, an emergency vehicle traveling at a high speed will be "proximate" to a motor car at a second, greater, distance.

The receiver is mounted in each vehicle in a location, such as under the dashboard, which will be located with respect to the person in control of the vehicle such that warning signals generated by the receiver will be clearly heard by the operator no matter what other distractions, such as cell phones, radios or the like, are present.

Each receiver includes a proximity system 32 which generates a proximity signal 34 upon receipt of the warning signal. The proximity system has circuitry 36 which increases the strength of the proximity signal as the first and second entities approach each other. The receiver further includes circuitry 38 which differentiates between the various signals associated with different warning entities whereby a unique signal from one warning entity, such as a school zone, will be differentiated and handled differently, by the circuitry in the proximity system to generate signals that are associated with and unique to the particular unique signal received, as will be understood by those skilled in the art based on the teaching of the present disclosure. Thus, for example, a unique signal 34' will be generated by system 32 upon receipt of a signal associated with a school bus whereas another unique signal 34" will be generated upon receipt of a signal from an ambulance, and so forth. These unique signals will be handled as discussed below. The details of the differentiating circuitry are not important to this disclosure and thus will not be discussed or claimed.

Each receiver further includes a first warning system 40, such as a row of lights having a first color, such as yellow, associated with a first type of traffic entity, such as a school zone, a school bus or a train. The first warning system is connected to the proximity system to receive a proximity signal generated by and unique to the first type of traffic entity and includes first circuitry 44 for generating a first warning signal 46, such as a light signal, that changes, such as in increasing intensity, as the proximity signal strength associated with the first traffic entity increases. First warning system 40 further includes second circuitry 48 for generating a second warning signal 50, such as an audible signal, that differs from the first warning signal of the first warning system and changes, such as increasing in intensity, as the proximity signal strength associated with the first type of traffic entity further increases due to decreasing distance or increased closing speed between the receiver and the transmitter associated with the first type of traffic entity.

Thus, for example, first warning system 40 generates a visible and increasingly bright signal based on the approach of the vehicle containing the receiver to a school zone which has a transmitter that generates a warning signal that is unique to school zones. System 32 receives the signal unique to the school zone and translates that signal into a signal, such as 34', that is unique to and associated with, the school zone warning signal. The signal 34' is then received and used by first circuitry 44 to create a visible signal which increases in intensity as the vehicle continues to approach the school zone. Upon closer approach, an audible signal is generated which can replace or augment the visible signal, with the audible signal growing louder as the vehicle continues to approach the school zone. A school bus that is stopped to load or unload passengers will be treated in similar manner.

In this manner, the driver of a motor vehicle will be warned that he is initially approaching or is being initially approached, by a vehicle such as a school zone or school bus or train; and will be warned by an increasingly intense first signal and then by an increasingly intense second signal that either replaces or augments the first signal, that the distance between his vehicle and the other vehicle or zone which requires his yielding of the right of way to the other vehicle or zone is further decreasing or the vehicle associated with the receiver is increasing its speed toward the first type of traffic entity.

Since modern traffic includes a wide variety of vehicles and entities that require another entity, such as car, to change its driving mode, system 10 includes further systems that are associated with other warning vehicles or entities.

Thus, system 10 further comprises a second warning system 60 associated with a second type of traffic entity, such as a fire truck, or an ambulance. The second warning system is connected to the proximity system to receive a proximity signal generated by the second type of traffic entity and which is unique to and associated with the second type of traffic entity. System 60 includes first circuitry 62 for generating a first warning signal 64, such as a red light, that changes, such as growing brighter, as the proximity signal strength associated with the second traffic entity increases due to the decreasing distance between the vehicle and the second type of traffic entity. The second warning system further includes second circuitry 66 for generating a second warning signal 68 that differs, such as in color, from the first warning signal of the second warning system and changes, such as by becoming brighter, as the proximity signal strength associated with the second type of traffic entity increases due to decreasing distance or increasing closing speed between the receiver and the transmitter associated with the second type of traffic entity.

System 10 further comprises a third warning system 80 associated with a third type of traffic entity, such as police vehicles. The third warning system is connected to the proximity system to receive a proximity signal generated by the third type of traffic entity and includes first circuitry 82 for generating a first warning signal 84, such as a blue light, that changes as the proximity signal strength associated with the third traffic entity increases with respect to the first traffic entity. The third warning system further includes second circuitry 86 for generating a second warning signal 88, such as an audible signal, that differs from the first warning signal of the third warning system and changes as the proximity signal strength associated with the third type of traffic entity increases.

Each receiver further includes a mute circuit 90 for disabling the second warning signal from any warning system and a power switch 92 for manually disabling the entire receiver. The receiver can be connected to the electrical system of the warned vehicle so it automatically turns on when the vehicle is started.

The particular details of the transmitter, or transmitters, and the receiver or receivers, and the circuits involved are not important to the present disclosure and thus will not be claimed or discussed. It is noted, however, that those skilled in the art will understand the details necessary based on their own knowledge and knowledge in the literature, which includes the patent literature, such as U.S. Pat. Nos. 4,238,778, 4,573,778, 4,764,978 and 6,025,789, and the patents disclosed therein, the disclosures of which are fully incorporated herein by reference thereto.

As will be understood from this disclosure, the present invention also is embodied in a method for warning a traffic entity that a situation requiring the change of driving mode will be required. As will also be understood, the method comprises alerting a moving traffic entity to the presence of a second traffic entity; requiring the moving traffic entity to change its movement when it is proximate to the second traffic entity; changing the alert as by increasing the intensity of the alert as the distance between the moving traffic entity and the second traffic entity decreases or as the relative speed between the two entities increases; and changing the alert by changing the mode of the alert as by changing from a visible alert to either an audible alert or a combined visible and audible alert, as the distance between the two entities further decreases or as the relative speed between the two entities further increases. The method further includes the using several different alerts to account for different entities.

Figure 2:
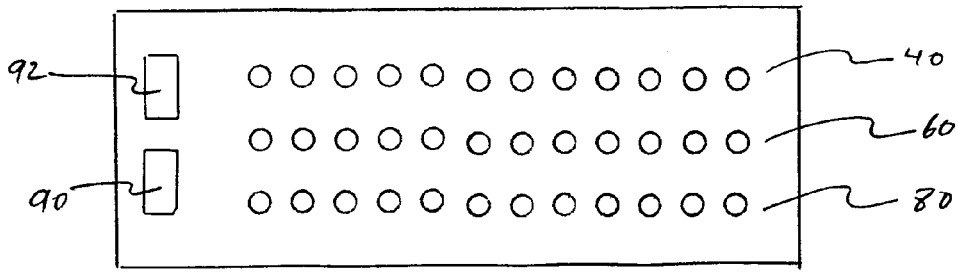
FIG. 2 is a perspective view of a receiver that is mounted in an entity, such as a motor vehicle, that must yield the right of way to another entity, such as an emergency vehicle.

As can be understood from FIG. 2, the first warning signals can take the form of rows of lights. The first light or first several lights in a row will illuminate when the warning signal is initially detected depending on the distance between the two entities as discussed above. As the distance between the two entities decreases, or the relative speed of the two entities increases, more lights in the row will illuminate, thus increasing the intensity of the signal. After a preset distance or a preset relative speed, an audible signal will be activated. For example, the audible signal will be activated when the sixth light, of twelve in a row, is illuminated. In the form of the receiver shown in FIG. 2, the lights will take the form of three rows of twelve lights each. The first row of lights may have a first color representing the first warning system 40; the second row of lights may have a second color representing the second warning system 60; and the third row of lights may have a third color representing the third warning system 80. The audible signal can replace or augment the visual signal provided by the lights in the row. A speaker can be included on the receiver to generate the audible signal.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A system for warning a traffic entity that a situation requiring the change of driving mode will be required comprising:

A) a first traffic entity which will affect the movement of another traffic entity, the first entity having a transmitter therein which transmits a unique warning signal over the air;

B) a second traffic entity which will have its traffic movement affected by the presence of the first entity, the second traffic entity including a receiver which will receive a warning signal from the transmitter in the first entity when the first and second entities are proximate to each other, the receiver including:

(1) a proximity system which generates a proximity signal upon receipt of the warning signal, the proximity signal increasing in strength as the first and second entities approach each other, (2) a first warning system associated with a first type of traffic entity, the first warning system being connected to the proximity system to receive a proximity signal generated by the first type of traffic entity and including first circuitry for generating a first warning signal that changes as the proximity signal strength associated with the first traffic entity increases, the first warning system further including second circuitry for generating a second warning signal that differs from the first warning signal of the first warning system and changes as the proximity signal strength associated with the first type of traffic entity further increases, (3) a second warning system associated with a second type of traffic entity, the second warning system being connected to the proximity system to receive a proximity signal generated by the second type of traffic entity and including first circuitry for generating a first warning signal that changes as the proximity signal strength associated with the second traffic entity increases, the second warning system further including second circuitry for generating a second warning signal that differs from the first warning signal of the second warning system and changes as the proximity signal strength associated with the second type of traffic entity further increases, (4) a third warning system associated with a third type of traffic entity, the third warning system being connected to the proximity system to receive a proximity signal generated by the third type of traffic entity and including first circuitry for generating a first warning signal that changes as the proximity signal strength associated with the third traffic entity increases, the third warning system further including second circuitry for generating a second warning signal that differs from the first warning signal of the third warning system and changes as the proximity signal strength associated with the third type of traffic entity further increases, and (5) a mute circuit for disabling the second warning signal from any warning system;

the first warning signal of the first warning system specifically indicating a presence of the first type of traffic entity, the first warning signal of the second warning system specifically indicating a presence of the second type of traffic entity, and the first warning signal of the third warning system specifically indicating a presence of the third type of traffic entity; and the first type of traffic entity being at least one entity selected from a group consisting of a school zone, a school bus, and a train, the second type of traffic entity being at least one entity selected from a group consisting of a fire truck and an ambulance, and the third type of traffic entity being a police vehicle.

2. The system defined in claim 1 wherein each of the first warning systems includes signal lights.

3. The system defined in claim 2 wherein each of the second warning systems includes an audible signal generator.

4. The system defined in claim 3 wherein the receiver further includes a mute circuit connected to the audible signal generator.

5. A method for warning a traffic entity that a situation requiring the change of driving mode will be required comprising:

A) alerting a moving traffic entity to the presence of a second traffic Entity;

B) requiring the moving traffic entity to change its movement when it is proximate to the second traffic entity;

C) changing the alert as the distance between the moving traffic entity and the second traffic entity decreases or as the relative speed between the moving traffic entity and the second traffic entity changes; and D) changing the alert by changing the mode of the alert as the distance and/or speed of the moving traffic entity further changes with respect to the second traffic entity;

the step of alerting the moving traffic entity to the presence of the second traffic entity including providing a signal specifically indicating a presence of a first type of traffic entity. providing a signal specifically indicating a presence of a second type of traffic entity, and providing a signal specifically indicating a presence of a third type of traffic entity; and the first type of traffic entity being at least one entity selected from a group consisting of a school zone, a school bus, and a train, the second type of traffic entity being at least one entity selected from a group consisting of a fire truck and an ambulance, and the third type of traffic entity being a police vehicle.

6. The method defined in claim 5 wherein the mode of the alert is changed from visible to audible.

7. The method defined in claim 6 wherein the second traffic entity is moving.

8. The method defined in claim 6 wherein the second traffic entity is stationary.

9. The method defined in claim 6 further including a plurality of different traffic entities and providing a separate and unique alert for each traffic entity.

10. The method defined in claim 5 wherein the alert is changed by increasing or decreasing the intensity of the alert.

11. The method defined in claim 5 wherein the first type of traffic entity is at least one entity selected from a group consisting of the school zone and the school bus.

12. The system defined in claim 1 wherein the first type of traffic entity is at least one entity selected from a group consisting of the school zone and the school bus.

13. A system for warning a traffic entity that a situation requiring the change of driving mode will be required comprising:

C) a first traffic entity which will affect the movement of another traffic entity, the first entity having a transmitter therein which transmits a unique warning signal over the air;

D) a second traffic entity which will have its traffic movement affected by the presence of the first entity, the second traffic entity including a receiver which will receive a warning signal from the transmitter in the first entity when the first and second entities are proximate to each other, the receiver including:

(1)a proximity system which generates a proximity signal upon receipt of the warning signal, the proximity signal increasing in strength as the first and second entities approach each other, (2) a first warning system associated with a first type of traffic entity, the first warning system being connected to the proximity system to receive a proximity signal generated by the first type of traffic entity and including first circuitry for generating a first warning signal that changes as the proximity signal strength associated with the first traffic entity increases, the first warning system further including second circuitry for generating a second warning signal that differs from the first warning signal of the first warning system and changes as the proximity signal strength associated with the first type of traffic entity further increases, (3) a second warning system associated with a second type of traffic entity, the second warning system being connected to the proximity system to receive a proximity signal generated by the second type of traffic entity and including first circuitry for generating a first warning signal that changes as the proximity signal strength associated with the second traffic entity increases, the second warning system further including second circuitry for generating a second warning signal that differs from the first warning signal of the second warning system and changes as the proximity signal strength associated with the second type of traffic entity further increases, (4) a third warning system associated with a third type of traffic entity, the third warning system being connected to the proximity system to receive a proximity signal generated by the third type of traffic entity and including first circuitry for generating a first warning signal that changes as the proximity signal strength associated with the third traffic entity increases, the third warning system further including second circuitry for generating a second warning signal that differs from the first warning signal of the third warning system and changes as the proximity signal strength associated with the third type of traffic entity further increases, and (5) a mute circuit for disabling the second warning signal from any warning system;

the first warning signal of the first warning system specifically indicating a presence of the first type of traffic entity, the first warning signal of the second warning system specifically indicating a presence of the second type of traffic entity, and the first warning signal of the third warning system specifically indicating a presence of the third type of traffic entity; and the first type of traffic entity being at least one entity selected from a group consisting of a school zone, a school bus, and a train.

* * * * *